US009683808B2

(12) United States Patent
Gagnon

(10) Patent No.: US 9,683,808 B2
(45) Date of Patent: Jun. 20, 2017

(54) SYSTEM FOR ATTACHING A HANDGUARD TO A FIREARM

(71) Applicant: William Gagnon, Corona, CA (US)

(72) Inventor: William Gagnon, Corona, CA (US)

(73) Assignee: Superior Metal Fabrications, Inc., Riverside, CA (US)

( * ) Notice: Subject to any disclaimer, the term of this patent is extended or adjusted under 35 U.S.C. 154(b) by 0 days.

(21) Appl. No.: 14/921,962

(22) Filed: Oct. 23, 2015

(65) Prior Publication Data

US 2017/0115094 A1 Apr. 27, 2017

(51) Int. Cl.
*F41C 23/16* (2006.01)

(52) U.S. Cl.
CPC ..... *F41C 23/16* (2013.01)

(58) Field of Classification Search
CPC ..... F41C 23/00; F41C 23/16; F41C 27/00
USPC ..... 42/75.01, 75.03
See application file for complete search history.

(56) References Cited

U.S. PATENT DOCUMENTS 6,854,206 B2 * 2/2005 Oz ..... F41G 1/34 42/111
7,770,317 B1 8/2010 Tankersley
7,793,452 B1 * 9/2010 Samson ..... F41C 23/16 42/71.01
8,037,633 B1 * 10/2011 Troy ..... F41C 23/16 42/71.01
8,201,353 B1 * 6/2012 Swan ..... F41C 23/16 42/71.01
8,234,808 B2 * 8/2012 Lewis ..... F41A 3/26 42/71.01
8,607,490 B1 * 12/2013 Zinsner ..... F41C 23/16 42/71.01
8,726,559 B1 * 5/2014 Mueller ..... F41A 21/482 42/75.02
9,279,638 B2 * 3/2016 Adair ..... F41C 23/16
9,303,949 B1 * 4/2016 Oglesby ..... F41C 23/16
9,389,043 B1 * 7/2016 Zhang ..... F41C 23/16
2006/0236582 A1 * 10/2006 Lewis ..... F41A 3/26 42/73
2011/0126443 A1 * 6/2011 Sirois ..... F41C 23/16 42/90
2011/0247254 A1 * 10/2011 Barnes ..... F41A 21/48 42/71.01

(Continued)

*Primary Examiner* — Derrick Morgan
(74) *Attorney, Agent, or Firm* — Thorpe North & Western LLP

(57) ABSTRACT

A firearm handguard includes a hollow interior cavity extending from a receiving end to an exit end of the handguard, and forms a receiving end portion. An attachment mechanism is screwed to the usual receiver head on the firearm receiver which secures the attachment mechanism to the firearm receiver. The attachment mechanism is received in the receiving end portion of the handguard. A projection extends from either the attachment mechanism or the handguard and a mating recess is provided in the other of the attachment mechanism or the handguard to receive and hold the projection. The inside diameter of the receiving end portion of the handguard can be enlarged or reduced so that the attachment mechanism can be received in the receiving end portion and the projection then received and held by the mating recess to thereby attach it to the attachment mechanism and hold it against relative longitudinal movement.

20 Claims, 6 Drawing Sheets

(56) References Cited

U.S. PATENT DOCUMENTS

| | | | | |
|---|---|---|---|---|
| 2012/0180358 | A1* | 7/2012 | Samson | F41A 13/12 42/71.01 |
| 2012/0186123 | A1* | 7/2012 | Troy | F41G 11/003 42/71.01 |
| 2012/0324775 | A1* | 12/2012 | Troy | F41C 23/16 42/71.01 |
| 2013/0205637 | A1* | 8/2013 | Patel | F41A 3/66 42/75.02 |
| 2014/0076146 | A1* | 3/2014 | Gomez | F41A 21/487 89/191.01 |
| 2014/0130390 | A1* | 5/2014 | Geissele | F41C 23/16 42/71.01 |
| 2014/0165444 | A1* | 6/2014 | Masters | F41A 21/484 42/75.02 |
| 2014/0373419 | A1* | 12/2014 | Leclair | F41C 23/16 42/71.01 |
| 2015/0168095 | A1* | 6/2015 | Dubreuil | F41C 23/16 42/90 |
| 2015/0316347 | A1* | 11/2015 | Shea | F41C 23/16 42/75.02 |
| 2016/0091276 | A1* | 3/2016 | Miller | F16B 39/04 42/75.02 |
| 2016/0116251 | A1* | 4/2016 | Mather | F41A 21/482 42/71.01 |

* cited by examiner

SYSTEM FOR ATTACHING A HANDGUARD TO A FIREARM

BACKGROUND

Firearm handguards are known in the art to provide protection and comfort to the user. Certain shapes and sizes of handguards are more easily and comfortably gripped by users. Additionally, different textures and materials may be used. Handguards on or near the barrel provide the user protection against heat generated by using the firearm. However, the torque from the user's grip on the handguard can negatively impact the aim and accuracy of the firearm. One solution in the art to the problems caused by grip torque is a handguard that does not physically touch the barrel, or a free float handguard. Free float handguards traditionally attach to the firearm receiver. The handguard surrounds the barrel without being mounted on it, allowing the barrel to "float."

Free-float handguards known in the art have disadvantages, however. Free float handguards are often used with gas operated rifles. These handguards must often be larger in circumference in order to accommodate the firearm gas tube. Current free float handguards may also become loose during use. Additionally, installing a free float handguard may require that the barrel or the barrel retaining nut is removed from the receiver. The process of attaching the barrel and barrel retaining nut to the receiver is a time intensive and laborious process because the barrel nut assembly used with such handguards usually includes apertures for the gas tube that need to be precisely aligned with the gas port on the firearm receiver. Additionally, the firearm performs best when the barrel is attached to the receiver with a certain torque tolerance. It is not uncommon for the barrel nut to be threaded to the receiver so that the gas tube aperture aligns, but the barrel is not attached within the ideal torque range. If the barrel nut is rotated further, the attachment pressure may reach the ideal torque, but the gas tube aperture might then be misaligned. Consequently, it is often necessary to insert metal shims between the barrel nut and upper receiver to create the proper spacing so that the gas tube aperture can be aligned when the attachment is within the proper torque range. This process often requires significant trial and error and contributes significantly to the time and cost required to assemble the firearm. Therefore, it is desirable that a system exists that solves the problem of free float handguards that become loose during use and that require too much time and effort to install.

SUMMARY OF THE INVENTION

Various aspects of the invention address some or all of the needs referenced above or a combination thereof. Aspects of the invention can include a system and method for attaching a handguard to a firearm receiver and securing a barrel to the firearm receiver.

According to the invention, an attachment mechanism is attached to a firearm receiver, such as by screwing the attachment mechanism to the usual threaded receiver head in a manner similar to that for mounting the usual barrel nut to the receiver. The attachment mechanism has an outside diameter to fit between the receiver head and the usual gas tube extending from the firearm receiver so no alignment of a gas tube aperture through the attachment mechanism with a gas tube outlet from the firearm receiver is necessary. A gas tube, if present, extends from the firearm receiver above the attachment mechanism of the invention.

The handguard of the invention includes a cavity extending from a receiving end to an exit end along a longitudinal length of the handguard and sized to receive a firearm barrel therethrough. The cavity extending through a handguard receiving end portion at the receiving end of the handguard is configured to receive the attachment mechanism therein when the handguard is attached to the firearm. A projection extends from one of the attachment mechanism or the handguard and a mating recess is provided in the other of the attachment mechanism or the handguard to receive and hold the projection when the handguard is attached to the attachment mechanism. The size of the cavity or gap, such as the inside diameter of the cavity or gap, extending through the handguard receiving end portion which receives the attachment mechanism can be enlarged or reduced so that the attachment mechanism can be received in the handguard receiving end portion and the projection can then be received and held by the mating recess to thereby attach the handguard to the attachment mechanism and prevent longitudinal movement of the handguard with respect to the attachment mechanism.

In several embodiments of the invention, the gap extending through the handguard receiving end portion of the handguard is normally sized so that it can closely receive the attachment mechanism therein, but because of a projection extending radially outwardly from the attachment mechanism or extending radially inwardly from the handguard into the gap in the handguard receiving end portion, the attachment mechanism cannot be fully inserted into the gap in the handguard receiving end portion, and the projection cannot be aligned with the receiving recess. In these embodiments, means is provided for resiliently increasing the size of the gap through the handguard receiving end portion of the handguard to allow the attachment mechanism to be fully inserted into the gap to the extent that the projection is aligned with the receiving recess. When the projection is aligned with the receiving recess, the size of the gap through the handguard receiving end portion is reduced to or toward its normal size so that the projection is received in the mating recess to attach the handguard to the attachment mechanism and the attachment mechanism is closely received in the gap. Locking means may be provided to maintain the size of the gap at this size wherein the projection is received in the receiving recess. To remove the handguard from the attachment mechanism and from the firearm, the size of the gap is again increased to allow the projection to come out of the recess and the attachment mechanism to be slid out of the gap.

In other embodiments of the invention, the gap extending through the handguard receiving end portion of the handguard is normally sized so that the attachment mechanism can be received in the gap even though a projection extends radially outwardly from the attachment mechanism or extends radially inwardly from the handguard into the gap in the handguard receiving end portion. In such case, the attachment mechanism can be fully inserted into the gap in the handguard receiving end portion, and the projection can be aligned with the receiving recess. However, without more, the handguard is not attached to the attachment mechanism and the attachment mechanism can slide out of the gap. In these embodiments, means is provided for decreasing the size of the gap through the handguard receiving end portion of the handguard when the projection is aligned with the receiving recess. When the projection is aligned with the receiving recess, the size of the gap through the handguard receiving end portion is reduced so that the projection is received in the mating recess to attach the handguard to the attachment mechanism and the attachment mechanism is closely received in the gap. Locking means may be provided to maintain the reduced size of the gap with the projection received in the receiving recess for as long as the handguard is to remain attached to the attachment mechanism and the firearm. To remove the handguard from the attachment mechanism and from the firearm, the size of the gap is allowed to increased to allow the projection to come out of the recess and the attachment mechanism to be slid out of the gap.

In some embodiments of the invention, the projection comprises a radial flange projecting outwardly from the attachment mechanism and the receiving recess comprises a mating radial groove extending into the handguard body from the gap extending through the handguard receiving end portion of the handguard, or the projection comprises a radial flange extending from the handguard into the gap extending through the handguard receiving end portion of the handguard and the receiving recess comprises a mating radial groove extending into the attachment mechanism.

BRIEF DESCRIPTION OF THE DRAWINGS

An embodiments of the present invention is shown and described in reference to the numbered drawings wherein.

It will be appreciated that the drawings are illustrative and not limiting of the scope of the invention that is defined by the claims. The embodiment shown accomplishes various aspects and objects of the invention. It is appreciated that it is not possible to clearly show each element and aspect of the technology in a single figure, and as such, multiple figures are presented to separately illustrate the various details of the technology in greater clarity. Similarly, not every embodiment need accomplish all advantages of the present technology.

DETAILED DESCRIPTION OF THE ILLUSTRATED EMBODIMENT

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

Figure 1:
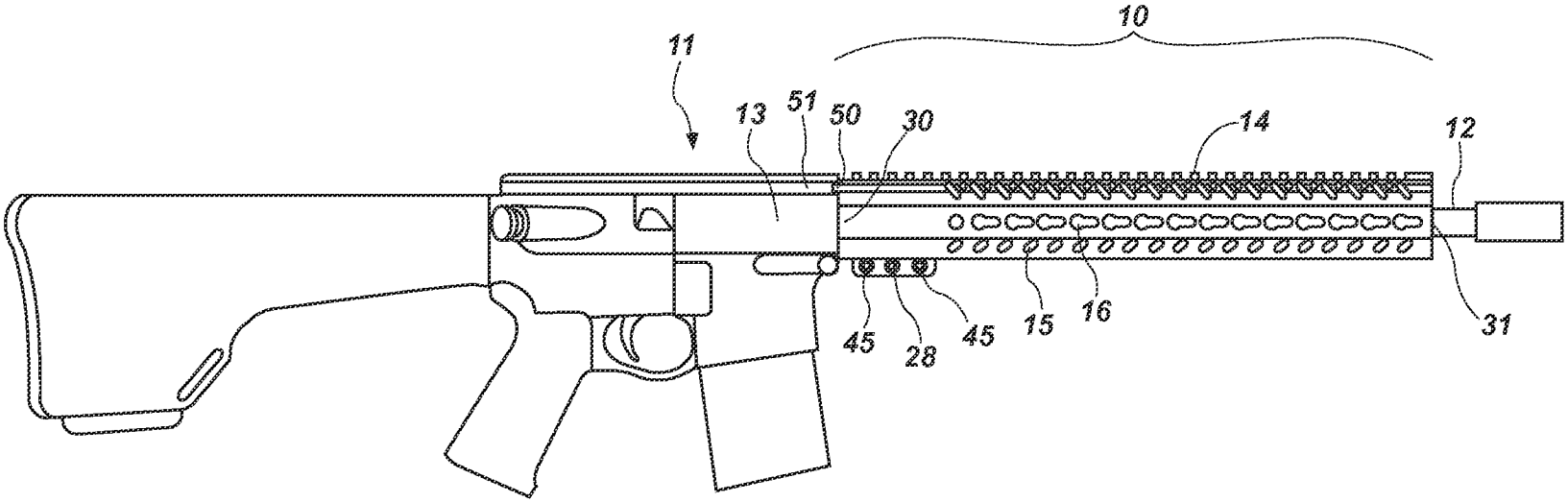
FIG. 1 shows a side view of a handguard attached to a firearm in accordance with one embodiment of the invention.
Figure 2:
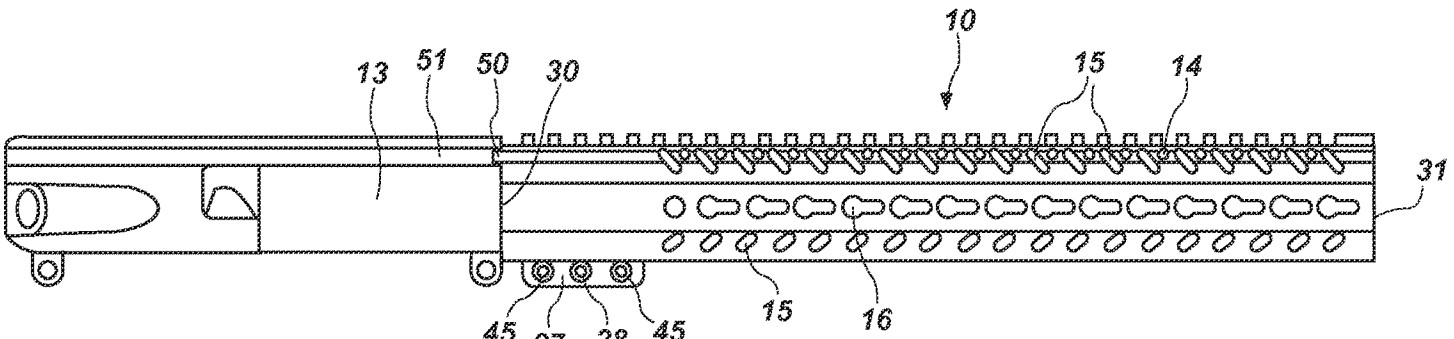
FIG. 2 shows a side view of the handguard attached to the receiver of the firearm.
Figure 6:
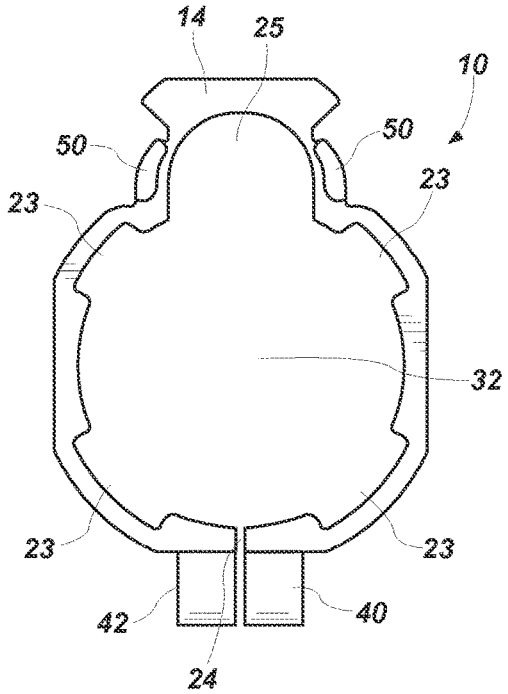
FIG. 6 shows an end view of the receiving end of the handguard in normal condition.

Turning now to the Figures, FIG. 1 shows a side view of a handguard, shown generally as 10, attached to a firearm 11 in accordance with one embodiment of the invention. The firearm 11 may be an AR-15, M-15, M4 type rifle, or any other firearm where a handguard is desirable. The handguard 10 may be comprised of a receiving end 30, an exit end 31, and a longitudinal cavity 32, FIGS. 4 and 6, extending from the receiving end 30 to the exit end 31 of the handguard and capable of receiving a barrel 12, FIGS. 1 and 11, therein and extending therethrough. The handguard 10 may be configured according to a wide variety and combination of shapes and sizes to provide comfort when gripped by the user and may be manufactured from a wide variety of suitable materials known in the art, according to different design considerations, including weight, conductivity, comfort, cost, and strength. It has been found satisfactory to form the handguard of 6063-T5 extruded aluminum.

Figure 4:
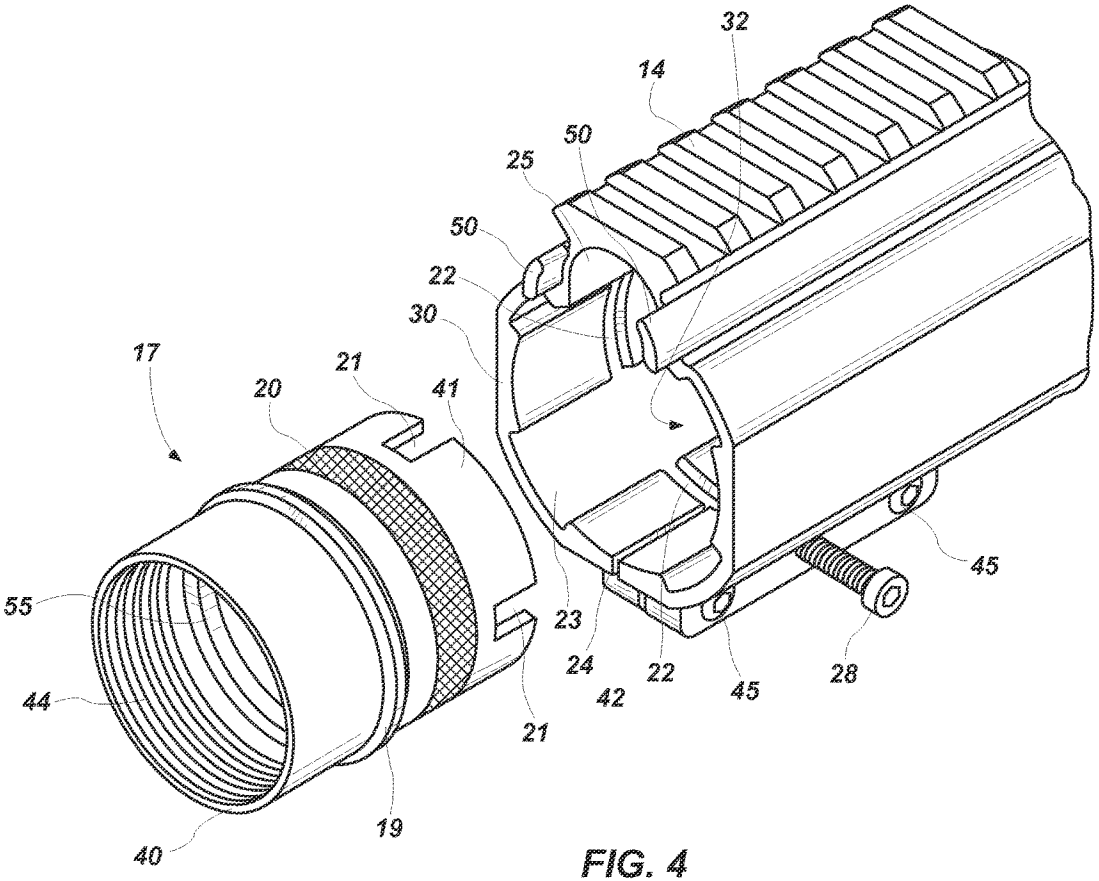
FIG. 4 shows pictorial view of the attachment mechanism and the receiving end portion of the handguard.

The handguard 10 may be attached to the firearm 11 so that the receiving end 30 is aligned directly against the upper receiver 13 of firearm 11 with the barrel 12 extending from the receiver 13 passing through the handguard 10. An attachment mechanism 17 may be directly attached to the upper receiver 13 with the handguard attached to the attachment mechanism 17 by positioning the receiving end 30 of the handguard over the attachment mechanism 17 so that the longitudinal cavity 32. FIG. 4, is positioned to receive the barrel 12, FIGS. 1 and 11. The handguard 10 may include tabs 50 that extend from the receiving end 30. The tabs 50 may be configured to align with a rail system 51 of the upper receiver 13 known in the art. When the handguard 10 is installed, the tabs 50 align with the rail system 51 and stabilize the handguard 10. They also keep the handguard 10 from rotating with respect to the receiver 13.

The handguard 10 may include openings, such as slots 15, along the lower and upper portions of handguard 10 and openings, such as slots 16, along the central side portions of handguard 10, and along the bottom, not shown, of the handguard 10 to reduce the weight of the handguard 10 and to allow ventilation and cooling air to flow into and along longitudinal cavity 32 around the barrel 12 to cool the barrel 12. The handguard 10 may also include a rail assembly 14, known in the art, such as a picatinny rail, to allow attachment of firearm accessories.

Figure 3:
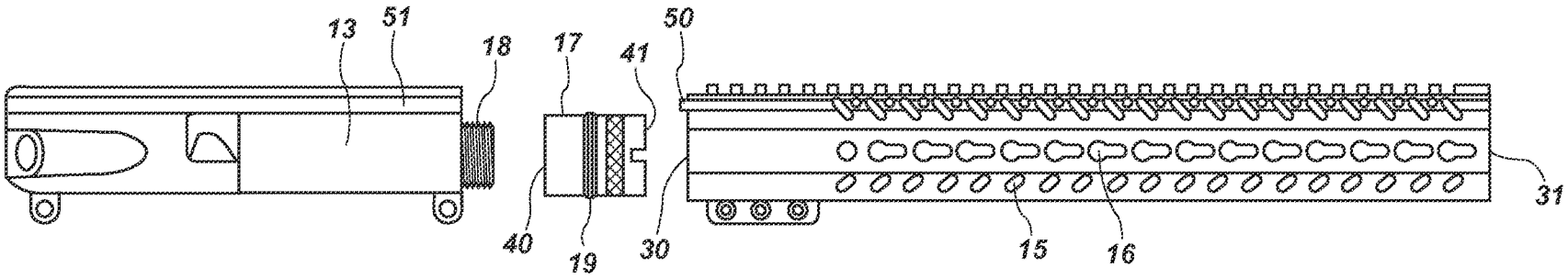
FIG. 3 shows a side view of a firearm receiver, an attachment mechanism, and a handguard.
Figures 11, 12:
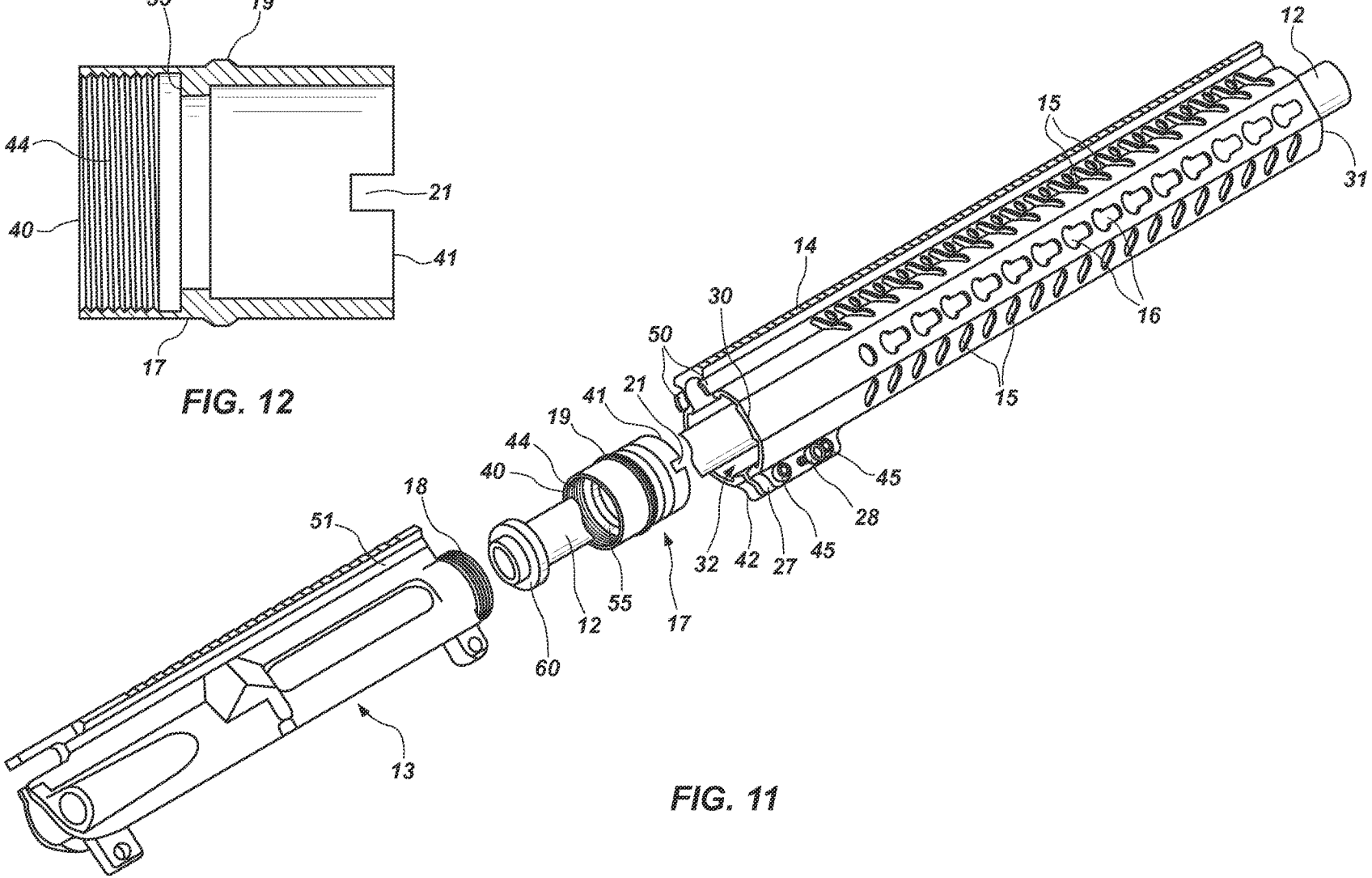
FIG. 11 shows a pictorial view of a firearm receiver, an attachment mechanism, and a handguard similar to FIG. 3, and showing a barrel to be attached to the receiver by the attachment mechanism.
FIG. 12 is a vertical section through the axial center of the attachment mechanism of FIG. 11 showing an inside configuration of the attachment mechanism.

The upper receiver 13 may be among many upper receiver types known in the art and may comprise a receiver head 18, FIGS. 3 and 11, that extends forwardly on the forward end of the upper receiver and is configured to accept the receiver end of a barrel 12, FIG. 11, and a barrel attachment means as known in the art, such as a known barrel nut, not shown. The receiver head 18 may be cylindric, externally threaded, and configured to have the attachment means screwed onto the receiver head to attach the barrel to the receiver. In the present invention, the usual barrel nut is replaced by the attachment mechanism 17 of the invention. In one embodiment of the invention, the attachment mechanism may comprise a hollow cylinder having a receiver end 40, FIGS. 3 and 4, and a handguard attachment end 41. The receiver end 40 may include internal threading 44, FIGS. 4, 11, and 12. In the embodiment illustrated, the illustrated barrel 12, as known in the art, includes a radial ring 60, FIG. 11, secured to and extending from around the receiver end of the barrel 12, configured so that the receiver end of barrel 12 can be inserted into the receiver head 18. The radial ring 60 has a circumference approximately the same as the receiver head 18, so the radial ring 60 rests against the end of the receiver head 18 and positions the barrel 12. The barrel 12 can then be attached to the upper receiver 13 by sliding the attachment mechanism 17 over the barrel 12 and down its length until the receiver end 40 of the attachment mechanism 17 contacts the receiver head 18, and is then screwed onto receiver head 18. When using a barrel with a radial ring such as radial ring 60, the attachment mechanism 17 will usually include an inner radial shoulder 55, FIGS. 4, 11, and 12, at the inner end of internal threads 44 of the attachment mechanism 17. The inner radial shoulder 55 is configured to contact the radial ring 60 and hold it firmly against the receiver head end, thereby firmly attaching the barrel 12 to the upper receiver 13.

Usually it is desirable to ensure a secure attachment of the barrel to the upper receiver, which requires a tight fit of the attachment mechanism 17 on the receiver head 18 to tightly hold the barrel securement, such as barrel radial ring 60, FIG. 11, tightly against the end of upper receiver head 18. This means that the attachment mechanism 17 must be screwed tightly onto the receiver head 18. For this purpose, the handguard attachment end 41 of the attachment mechanism 17 is castled with slots 21, FIGS. 4, 5, and 11, extending into attachment mechanism 17 from handguard attachment end 41. Slots 41 are sized and spaced to receive a spanner wrench or other torque wrench so that attachment mechanism 17 can be tightened to receiver head 18 with a desired torque setting, such as, for example, about fifty ft. lbs. torque. The degree of tightening will depend upon the particular firearm being used and other factors known in the art. As with the handguard, the attachment mechanism may be manufactured from a wide variety of suitable materials known in the art, according to different design considerations, including cost and strength. It has been found satisfactory to form the attachment mechanism from type 303 stainless steel.

It is also important when attaching a handguard to the firearm, that the handguard be securely attached and cannot move, particularly in a longitudinal direction, with respect to the firearm and barrel of the firearm. The current invention provides a connection between the handguard and the attachment mechanism which prevents longitudinal movement between the handguard and the attachment mechanism when the handguard is attached to the attachment mechanism. This connection is provided by a projection extending from either the attachment mechanism or the handguard which is received by a receiving indentation in the other of the handguard or attachment mechanism. For example, in the illustrated embodiment, the attachment mechanism 17 may include a projection in the form of a radial flange 19, FIGS. 4, 5, 3, 11, and 12, which extends or protrudes from the attachment mechanism 17. The outside diameter of radial flange 19 is larger than the outside diameter of the rest of the attachment mechanism 17. The radial flange 19 may be comprised of the same material as the attachment mechanism 17 and may be formed integrally with the attachment mechanism 17 or may be of different material and/or may be formed separately from the attachment mechanism 17.

Figure 9:
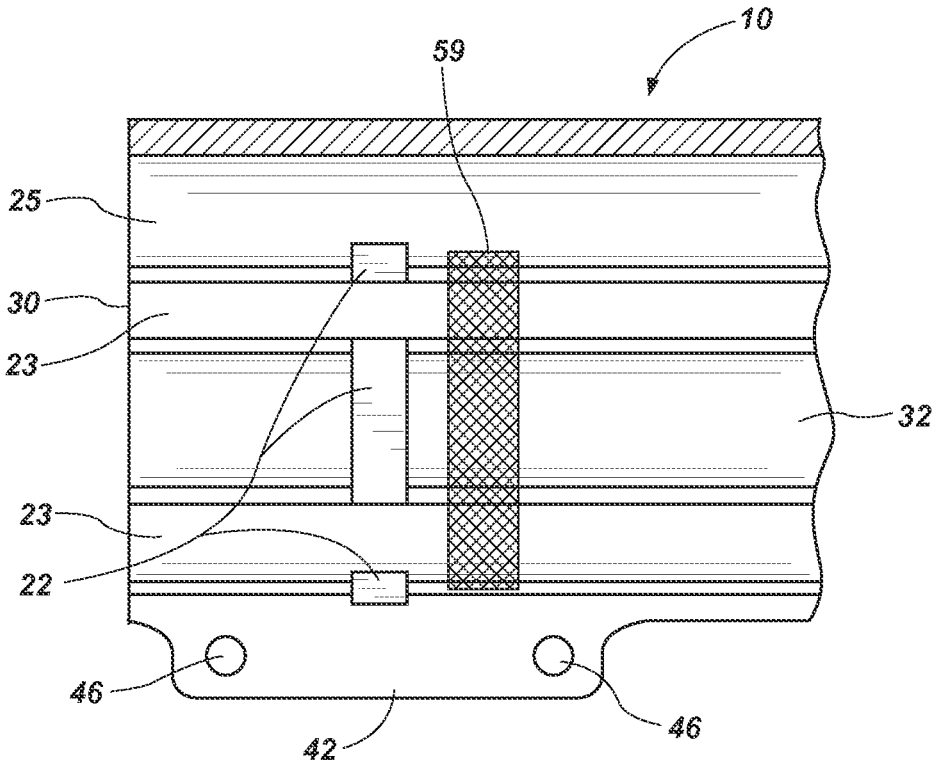
FIG. 9 shows a fragmentary vertical section through the axial center of the receiving end portion of the handguard.
Figure 10:
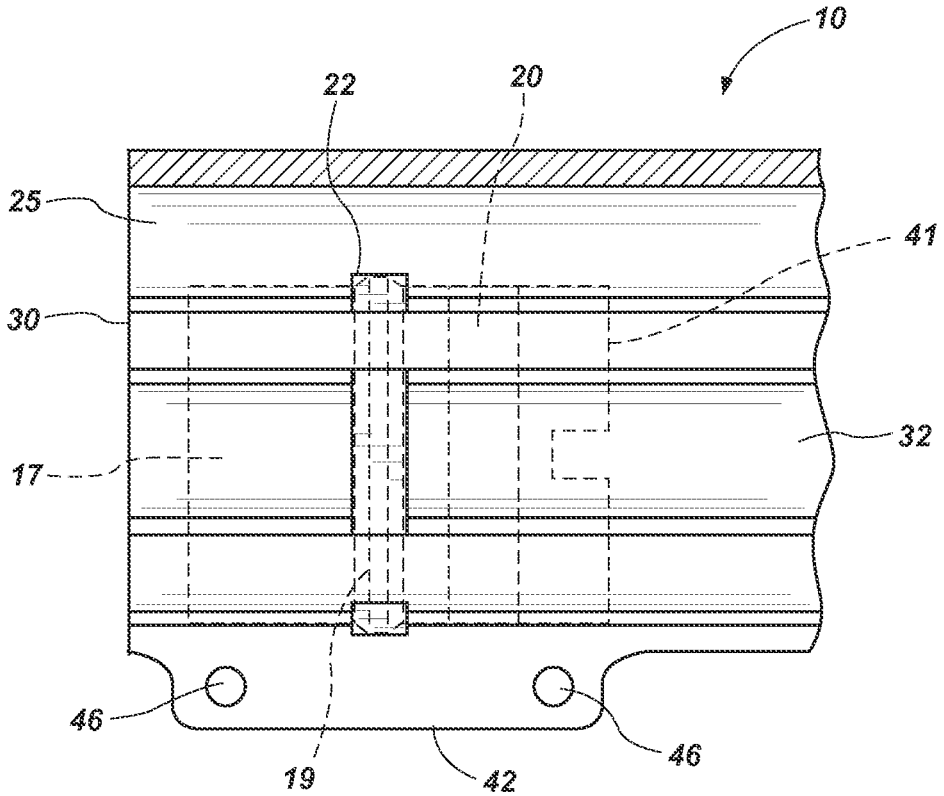
FIG. 10 shows a fragmentary vertical section through the axial center of the receiving end portion of the handguard as shown in FIG. 9, and showing in broken lines an attachment mechanism in position in the receiving end of the handguard.

With the radial flange 19 extending from the attachment mechanism 17, the handguard 10 will include a radial groove 22, FIGS. 4, 9, and 10, along the inside surface of the handguard 10 configured to receive the radial flange 19 when the handguard receiving end 30 is positioned over the attachment mechanism 17. i.e., the attachment mechanism slides into the receiving end 30 of the handguard 10, so the radial flange 19 can fit into the radial groove 22 and lock the handguard 10 to the attachment mechanism 17. In order to position the handguard receiving end 30 over the attachment mechanism 17, the opening of the handguard longitudinal cavity 32 at the receiving end 30 of the handguard 10 has to be of an inside diameter large enough to accept the radial flange 19 therein and allow the radial flange 19 to align with radial groove 22 in handguard 10 during the positioning operation. Then to lock the barrel 12 to the attachment mechanism 17, the inside diameter of the receiving end 30 of the handguard 10 has to be reduced so that the diameter of radial groove 22 is reduced to closely surround radial flange 19 and securely hold radial flange 19 received within radial groove 22. To do this, either the normal inside diameter of the receiving end 30 of the handguard 10 is smaller than the outside diameter of radial flange 19 and the inside diameter of the receiving end 30 of the handguard 10 is increased when the attachment mechanism 17 is to be inserted into the receiving end 30 of the handguard, and when radial flange 19 is aligned with radial groove 22 the inside diameter of the receiving end 30 of the handguard is allowed to return to its normal inside diameter so as to closely surround radial flange 19 and securely hold radial flange 19 received within radial groove 22, or if the normal inside diameter of the receiving end 30 of the handguard 10 is equal to or larger than the outside diameter of radial flange 19 so the attachment mechanism 17 can be inserted into the receiving end 30 of the handguard 10, then when radial flange 19 is aligned with radial groove 22, the inside diameter of the receiving end 30 of the handguard has to be reduced so the radial groove 22 will closely surround radial flange 19 and securely hold radial flange 19 received within radial groove 22. In either case, when the handguard 10 is attached to attachment mechanism 17, radial flange 19 fits into the radial groove 22 and locks the handguard 10 from sliding longitudinally with respect to attachment mechanism 17. If the outer diameter of the radial flange 19 is approximately the same as the inside diameter of the cavity 32 at the receiving end 30 of the handguard 10, it may be necessary to apply force to the barrel to slide it over the attachment mechanism 17 to align the radial flange 19 with the radial groove 22. In some cases low impact force, for example with a rubber hammer, can be applied to force the barrel over the attachment mechanism.

Figure 7:
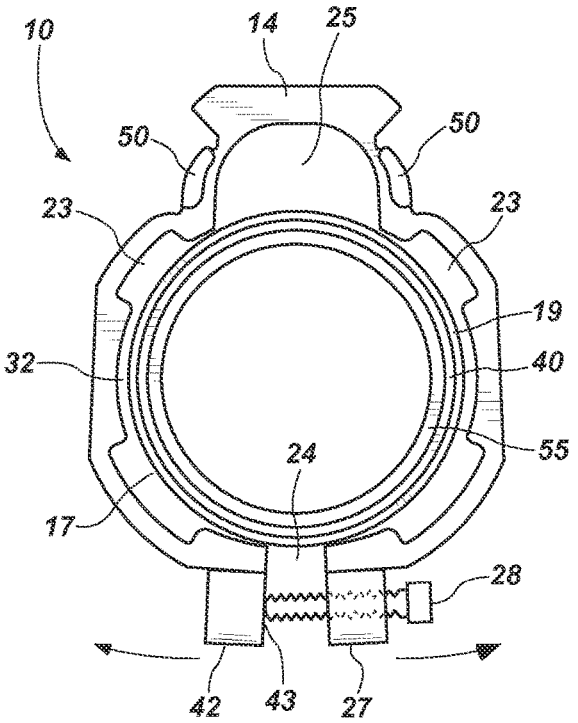
FIG. 7 shows an end view of the receiving end of the handguard similar to that of FIG. 6, but with the receiving end portion of the handguard in expanded position, and with the attachment mechanism inserted.
Figure 8:
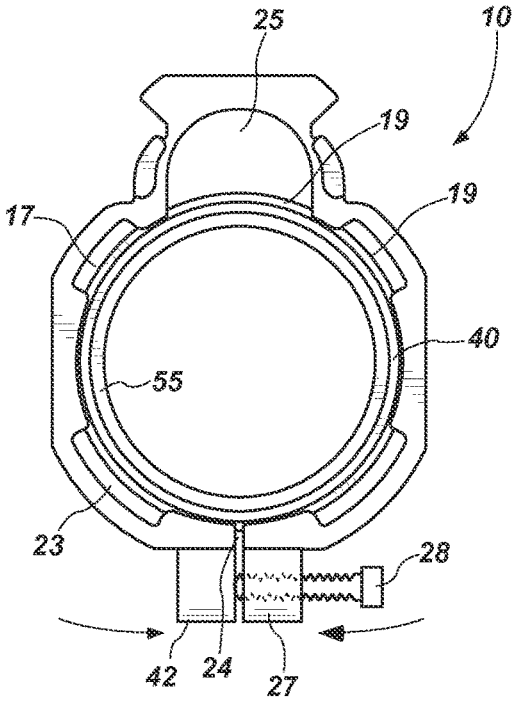
FIG. 8 shows an end view of the receiving end of the handguard similar to that of FIG. 6, with the receiving end portion of the handguard in normal condition as in FIG. 6, and with the attachment mechanism inserted.

In various embodiments of the invention, the handguard 10 may include a slit 24, FIGS. 4, 6, 7, and 8, extending into the handguard from the receiving end 30. Slit 24 allows the receiving end 30 and receiving end portion of handguard 10 to be expanded with a widening of slit 24 or narrowed with a narrowing of slit 24. In the illustrated embodiment, the normal inside diameter of the opening of longitudinal cavity 32 at the receiving end 30 of the handguard 10 is smaller than the outside diameter of radial flange 19. Thus, to receive the attachment mechanism 17 in the open receiving end 30 of the handguard, the opening in receiving end 30 of the handguard has to be expanded. For this purpose, a first tab 27, is provided along one side of slit 24 and a second tab 42 is provided along the other or opposite side of slit 24. A screw 28, FIGS. 4, 7, and 8, is threaded through the first tab 27 with the end 43 of screw 28, FIG. 7, disposed against the solid surface of second tab 42. When the screw 28 is turned to draw it through first tab 27, the first tab 27 and the second tab 42 are forced apart and slit 24 is forced to widen, as shown in FIG. 7, thereby increasing the size of the opening into cavity 32 at the receiving end 30 of the handguard 10. When the size of the cavity 32 is increased so that its inner diameter is larger than the outside diameter of the radial flange 19 of the attachment mechanism 17, the attachment mechanism 17 and radial flange 19 can be inserted into the cavity 32 of the handguard 10 and radial flange 19 can be aligned with radial groove 22. The screw 28 is then turned in the opposite direction to draw screw 28 away from second tab 42 to reduce the distance between the first tab 27 and second tab 42 and the width of slot 24, thereby allowing the receiving end 30 of the handguard 10 to move toward its normal inside diameter to decrease the inside diameter of the cavity 32 at the receiving end 30 of the handguard until the inner surface of the handguard 10 is in close contact with the outer surface of the attachment mechanism 17 and radial groove 22 closely receives radial flange 19, as shown in FIG. 8. This can be the normal inside diameter of the opening of longitudinal cavity 32 at the receiving end 30 of the handguard 10, or can be slightly expanded form the normal inside diameter. In this position, the barrel 12 is locked in place on attachment mechanism 17. The material from which the handguard 10 is made will usually be somewhat resilient so when the opening pressure provided by screw 28 is released, the handguard will return to its normal inside diameter and will generally remain at that normal diameter when the force of screw 28 is released. If desired, to ensure that the opening of longitudinal cavity 32 remains secure in this position with respect to attachment mechanism 17, locking screws 45, FIG. 4, may be provided which extend through holes through first tab 27, and are threaded into threaded holes 46, FIGS. 9 and 10, in second tab 42. With the barrel receiving end in position as shown in FIG. 8, locking screws 45 (not shown in FIG. 8) may be tightened against tab 27 to maintain the barrel receiving end in position as shown in FIG. 8. If it is desired to further tighten the barrel receiving end against the attachment mechanism 17 to increasing the contact pressure between the attachment mechanism 17 and handguard 10, locking screws 45 may be further tightened against tab 27.

If the normal inside diameter of the receiving end 30 of the handguard 10 is equal to or larger than the outside diameter of radial flange 19 so the attachment mechanism 17 can be inserted into the receiving end 30 of the handguard 10, enlarging the opening of longitudinal cavity 32 at the receiving end 30 of the handguard 10 is not necessary, so screw 28 to enlarge the opening is not necessary. In such case, when radial flange 19 is aligned with radial groove 22, locking screws 45 can be tightened to reduce the inside diameter of the receiving end 30 of the handguard 10 so radial groove 22 will be reduced in diameter to closely surround radial flange 19 and securely hold radial flange 19 received within radial groove 22.

It should be realized that while the illustrated embodiment shows radial flange 19 extending from attachment mechanism 17 and radial groove 22 being in handguard 10, these can be reversed so that the radial flange can extend from handguard 10 into the open cavity in the receiving end portion of handguard 10 and the radial groove can be in attachment mechanism 17. Operation of the invention by increasing the inside diameter of the receiving end 30 and the receiving end portion of handguard 10 to allow the attachment mechanism 17 to slide into the receiving end portion of handguard 10 and then allowing reduction of the inside diameter to receive the radial flange in the radial groove, or sliding the attachment mechanism 17 into a larger receiving end 30 and receiving end portion of handguard 10 and reducing the inside diameter of the receiving end 30 and the receiving end portion of handguard 10 to receive the radial flange in the radial groove, will be the same regardless of which parts have the radial flange and receiving groove.

In one embodiment of the invention, the handguard 10 may include channels 23, FIGS. 4, 6, 7, and 8, that extend lengthwise from the receiving end 30 along the inside surface of the handguard 10. The channels 23 allow air to flow between the handguard 10 and attachment mechanism 17, and beyond the attachment mechanism 17, along the barrel 12, to provide cooling air circulation along the barrel 12, and may also reduce the weight of the handguard 10.

Figure 5:
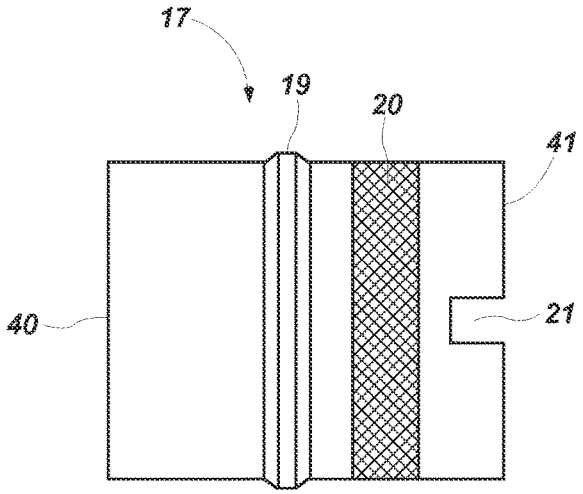
FIG. 5 shows a side view of the attachment mechanism.

The attachment mechanism 17 may further comprise a friction strip 20, FIGS. 4 and 5. The friction strip 20 may be comprised of scoring in attachment mechanism 17 or may be created by the addition of new material. The friction strip may allow a user to better hold and hand tighten attachment mechanism 17 on receiver head 18. Further, the handguard 10 may include a friction band 59, FIG. 9, configured and positioned to align with the friction strip 20, FIG. 10, of the attachment mechanism 17 once the radial flange 19 engages with the radial groove 22.

The handguard 10 may further include a chamber 25 capable of receiving a firearm gas tube extending from the upper receiver along and above the barrel. In this regard, it should be noted that attachment mechanism 17 has an outside diameter small enough to allow the attachment mechanism 17 to be positioned on receiver head 18 and fit between receiver head 18 and the usual gas tube that may be associated with the firearm. This eliminates the need for a gas tube aperture and eliminates the time intensive and laborious process of aligning a barrel retaining nut gas tube aperture with the gas port on the firearm receiver to receive the gas tube. With the attachment mechanism of the invention, the gas tube will freely extend over the outside of the attachment mechanism.

An example of the installation of an attachment mechanism 17 and a handguard 10 of the invention is to slide the attachment mechanism 17 over the barrel 12 with the castle forming the handguard attachment end 41 toward the front of barrel. The attachment mechanism 17 is tightened on the receiver head 18 to about fitly ft. lbs. using a spanner wrench or other torque wrench. The handguard is then attached to the attachment mechanism by sliding the handguard attachment end 30 over the attachment mechanism 17. To do this, lock screws 45, which may be 10/32 button head Torx screws, are removed from the handguard. Screw 28, which may be a 10/32-½" Allen head cap screw is inserted into the center threaded hole in tab 27 at the base of the handguard. Screw 28 is tightened until it bottoms out against tab 27 to expand the attachment end 30 of the handguard to allow the attachment end 30 of the handguard to slide over the attachment mechanism 17. The attachment end 30 of the handguard is then slid over the attachment mechanism 17. A minimal amount of force might be needed to get handguard to "snap" over attachment mechanism. In sliding the handguard 10 over the attachment mechanism 17, tabs 50, which form anti-rotation tabs, are slid into receiver rail system 51 to properly align the handguard 10 and prevent rotation of the installed handguard. Once in place over the attachment mechanism, the Allen head cap screw 28 is removed to allow the handguard to return to its normal position wherein radial flange 19 is received in and held in radial groove 22. Button head Torx screws 45 are inserted through the first tab 27 into securing holes 46 in tabs 42. Lock screws 45 can then be tightened. Care should be taken during installation to not use any metallic hammers to force handguard 10 over attachment mechanism 17. If needed, only rubber or plastic hammers should be used. To remove the handguard, the process used to attach the handguard is reversed. If the barrel is to be removed, the attachment mechanism is removed by reversing the process of attaching the attachment mechanism.

The foregoing detailed description describes the invention with reference to specific exemplary embodiments. However, it will be appreciated that various modifications and changes can be made without departing from the scope of the present invention as set forth in the appended claims. The detailed description and accompanying drawings are to be regarded as merely illustrative, rather than as restrictive, and all such modifications or changes, if any, are intended to fall within the scope of the present invention as described and set forth herein.

More specifically, while illustrative exemplary embodiments of the invention have been described herein, the present invention is not limited to these embodiments, but includes any and all embodiments having modifications, omissions, combinations, adaptations and/or alterations as would be appreciated by those in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, in the present disclosure, the term "preferably" is non-exclusive where it is intended to mean "preferably, but not limited to." Any steps recited in any method or process claims may be executed in any order and are not limited to the order presented in the claims. Means-plus-function or step-plus-function limitations will only be employed where, for a specific claim limitation, all of the following conditions are present in that limitation: a) "means for" or "step for" is expressly recited; and b) a corresponding function is expressly recited. The structure, material or acts that support the means-plus function are expressly recited in the description herein. Accordingly, the scope of the invention should be determined solely by the appended claims and their legal equivalents, rather than by the descriptions and examples given above.

What is claimed is:

1. A system for attaching a handguard to a firearm comprising:

a handguard comprising a handguard receiving end, a handguard receiving end portion, an exit end, and a cavity having a length extending through the handguard from the receiving end to the exit end and sized to receive a firearm barrel therethrough, a portion of the cavity extending through the handguard receiving end portion and configured to receive an attachment mechanism therein, said cavity having a normal size along the length which is rigidly formed by a portion of the handguard;

an attachment mechanism for attachment to a firearm receiver, wherein the attachment mechanism is inserted into the cavity extending through the handguard receiving end portion to attach the handguard to the firearm;

a projection extending from one of the attachment mechanism or the handguard;

a receiving recess in the other of the attachment mechanism or the handguard configured to align with and receive the projection when the handguard receiving end portion of the handguard is properly positioned with respect to the attachment mechanism and adapted to prevent relative longitudinal movement of the handguard with respect to the attachment mechanism when the projection is received in the receiving recess;

wherein the normal size of the cavity extending through the handguard receiving end portion closely receives the attachment mechanism whereby the projection is received in the receiving recess to not allow the attachment mechanism to slide into or out of the normal size cavity; and an assembly for manually resiliently increasing the size of the cavity extending through the handguard receiving end portion from the normal size to an increased size to allow the attachment mechanism to slide into or out of the cavity extending through the handguard receiving end portion when the cavity has an increased size.

2. The system of claim 1, wherein the attachment mechanism comprises a hollow cylinder, and wherein the portion of the cavity extending through the handguard receiving end portion is of similar cylindrical shape and the normal size closely receives the attachment mechanism therein.

3. The system of claim 1, wherein the assembly for manually resiliently increasing the size of the cavity extending through the handguard comprises:

a slit in the handguard receiving end portion, said slit having a normal width;

a first tab attached along one side of the slit;

a second tab attached along an opposite side of the slit; and a screw threaded through the first tab and disposed against the second tab, wherein turning the screw in one direction applies pressure against the second tab and separates the first tab from the second tab, thereby enlarging the slit and enlarging the cavity extending through the handguard receiving end portion sufficiently to allow the attachment mechanism to slide into the cavity, and turning the screw in the opposite direction releases pressure against the second tab allowing the second tab to approach the first tab, thereby allowing the slit and the cavity to return toward their normal sizes wherein the projection is received in the receiving recess to prevent relative longitudinal movement of the handguard with respect to the attachment assembly.

4. The system of claim 3, wherein the handguard further comprises:

at least one locking screw extending through an unthreaded opening in the first tab and threaded through the second tab, wherein turning the at least one locking screw in one direction tightens the at least one locking screw against the first tab thereby preventing the tabs from separating, additional turning of the at least one locking screw in the same direction draws the second tab toward the first tab, thereby narrowing the slit and reducing the size of the cavity extending through the handguard receiving end portion to more closely hold and/or clamp the attachment mechanism in the cavity, turning the at least one locking screw in the opposite direction allows the slit and the cavity to return to their normal sizes, and additional turning of the at least one locking screw in said opposite direction allows the tabs to be separated.

5. The system of claim 3, wherein the projection is a flange and the receiving recess is a mating groove.

6. The system of claim 5, wherein the flange is a radial flange and the mating groove is a radial groove.

7. The system of claim 6, wherein the radial flange extends from the attachment mechanism.

8. The system of claim 7, wherein the radial groove is perpendicular to the longitudinal length of the handguard.

9. The system of claim 1 wherein the cavity includes a chamber capable of receiving a firearm gas tube extending therethrough.

10. The system of claim 1, wherein the attachment mechanism includes a friction band.

11. The system of claim 10, wherein the cavity includes an inner friction band on the inner surface of the handguard.

12. The system of claim 11, wherein the inner friction band is configured to engage the friction band when the projection has engaged the receiving recess.

13. The system of claim 1, wherein the attachment mechanism includes a receiver end having interior threads capable of engaging complementary threads on a firearm receiver; and an adjustment end comprising at least one slot, wherein a tool may apply torque to the attachment end to rotate the attachment mechanism with respect to the receiver and tighten the attachment mechanism to the receiver.

14. The system of claim 1, wherein the cavity includes one or more ventilation channels therein extending from the receiving end to the exit end.

15. A method of attaching a handguard to a firearm comprising:

engaging inner threads on a receiving end of a cylindric attachment means with corresponding threads on a firearm receiver;

engaging a torque wrench to at least one slot on an adjustment end of the attachment means and rotating the attachment means until the attachment means is fixed to the firearm receiver;

removing the torque wrench from the slot and sliding the adjustment end of the attachment means into a cavity of a handguard, the cavity extending along a longitudinal length of the handguard;

rotating a threaded screw located in a first tab at a receiving end of the handguard, wherein the screw presses against a second tab at the receiving end of the handguard and increases the size of the cavity of the receiving end creating an enlarged receiving end cavity;

inserting the attachment mechanism into the enlarged receiving end cavity until an external flange on the attachment mechanism is aligned with a groove on an inside surface of the cavity;

counter-rotating the threaded screw, thereby engaging the external flange on the attachment means with the groove on the inner surface of the cavity so that the attachment means is locked from sliding further in or back out of the cavity.

16. A system for attaching a handguard to a firearm comprising:

a handguard comprising a receiving end, an exit end, a cavity extending from the receiving end to the exit end along a longitudinal length of the handguard and sized to receive a firearm barrel therethrough, and a handguard receiving end portion configured to receive an attachment mechanism;

an attachment mechanism for attachment to a firearm receiver, wherein the attachment mechanism is inserted into the handguard receiving end portion to attach the handguard to the firearm;

a projection extending from one of the attachment mechanism or the handguard;

a receiving recess in the other of the attachment mechanism or the handguard configured to align with and receive the projection when the handguard receiving end portion of the handguard is properly positioned with respect to the attachment mechanism and adapted to prevent relative longitudinal movement of the handguard with respect to the attachment assembly when the projection is received in the receiving recess;

wherein the handguard receiving end portion is of a normal size to closely receive the attachment mechanism whereby the projection will not allow the attachment mechanism to slide into or out of the normal size cavity; and a slit in the receiving end portion, said slit having a normal width;

a first tab attached along one side of the slit;

a second tab attached along an opposite side of the slit; and a screw threaded through the first tab and disposed against the second tab, wherein turning the screw in one direction applies pressure against the second tab and separates the first tab from the second tab, thereby enlarging the slit and enlarging the cavity extending through the handguard receiving end portion sufficiently to allow the attachment mechanism to slide into the cavity, and turning the screw in the opposite direction releases pressure against the second tab allowing the second tab to approach the first tab, thereby allowing the slit and the cavity to return to their normal sizes wherein the projection is received in the receiving recess to prevent relative longitudinal movement of the handguard with respect to the attachment assembly.

17. The system of claim 16, wherein the attachment mechanism comprises a hollow cylinder, and wherein the handguard cavity extending through the handguard receiving end portion is of similar cylindrical shape and is sized to receive the attachment mechanism therein.

18. The system of claim 16, wherein the projection is a flange and the receiving recess is a mating groove.

19. The system of claim 18, wherein the flange is a radial flange and the mating groove is a radial groove.

20. The system of claim 16 wherein the cavity includes a chamber capable of receiving a firearm gas tube extending therethrough.

* * * * *